US005808533A

United States Patent [19]

Büscher et al.

[11] Patent Number: 5,808,533

[45] Date of Patent: Sep. 15, 1998

[54] MODULAR RELAY

[75] Inventors: Thomas Büscher, Berlin; Heiko Reiss, Oberpoerlitz, both of Germany

[73] Assignee: Siemens Aktiengesellschaft, Munich, Germany

[21] Appl. No.: 704,762

[22] PCT Filed: May 2, 1995

[86] PCT No.: PCT/EP95/01657

§ 371 Date: Sep. 26, 1996

§ 102(e) Date: Sep. 26, 1996

[87] PCT Pub. No.: WO95/30995

PCT Pub. Date: Nov. 16, 1995

[30] Foreign Application Priority Data

May 5, 1994 [DE] Germany ..... 44 15 929.3
Apr. 13, 1995 [DE] Germany ..... 295 06 431 U

[51] Int. Cl.[6] ..... H01H 9/02; H01H 13/04

[52] U.S. Cl. ..... 335/202

[58] Field of Search ..... 335/78–86, 128, 335/202; 361/819

[56] References Cited

U.S. PATENT DOCUMENTS 4,400,761 8/1983 Hayden et al. ..... 361/400
4,971,566 11/1990 Adams et al. ..... 439/80
5,446,626 8/1995 Dittmann et al. ..... 361/785

FOREIGN PATENT DOCUMENTS

U 19 14 712 9/1964 Germany .
30 05 460 A1 1/1981 Germany .
33 06 019 C2 8/1984 Germany .
38 34 413 A1 4/1990 Germany .
A 37 54 47 4/1964 Switzerland .

*Primary Examiner*—Cassandra C. Spyrou
*Assistant Examiner*—Raymond Barrera
*Attorney, Agent, or Firm*—Hill, Steadman & Simpson

[57] ABSTRACT

The modular relay has a base (1) on which a relay system (2, 3, 4) is constructed, as well as a printed circuit board (6) which stands upright on the base. Contact elements (41*c*, 42*c*, 43) of the relay are directly connected to flat connectors in the base, via conductor elements. Further conductor elements in the base likewise form flat connectors as connections for a modular circuit which is arranged on the printed circuit board. All conductor elements of the base additionally form solder connecting pins (51*b* to 56*b*), which are integrally formed, which all emerge in a row on one side wall of the base, and which are soldered to the printed circuit board in the lower edge region of said printed circuit board. This results in a compact modular structure for a relay having a maximum number of connecting elements, the allocation of these connecting elements being variable for different modular circuits.

14 Claims, 5 Drawing Sheets

MODULAR RELAY

BACKGROUND OF THE INVENTION

The invention relates to a modular relay having a base, in which plug-in connecting elements for at least one load circuit, for one relay energizing circuit and for one modular circuit are anchored, having a coil former which is fitted with an electromagnet system with a coil, core and armature and which is mounted upright on the base, furthermore having at least one stationary contact element and at least one moving contact element coupled to the armature, the contact elements being connected directly to the associated connecting elements which are anchored in the base, and having a printed circuit board which stands upright on the base plane, is fitted with the modular circuit and is electrically connected to at least some of the connecting elements of the base.

For certain applications, for example in motor vehicle engineering, relays for specific functions are combined together with their drive circuit to form a compact unit, a so-called module, in a housing having plug-in connections, so that the relay can be replaced together with its drive circuit in one action. Typical examples are relays for flasher units, glow plugs and the like. However, until now, the structural connection of the relay system and the modular circuit which is arranged on a small printed circuit board required a relatively high level of complexity since a specific structure had to be developed for each application.

German reference DE 30 05 460 A1 discloses an electromagnetic switch having a basically modular structure of the type mentioned initially. This is actually a specific refinement as a glow-time relay which cannot directly be used for other operational purposes. The connections between the base and printed circuit board are not shown in detail; the connecting elements contain round connectors which must be separately riveted into holes in a connecting part in the form of a board.

German reference DE 33 06 019 C2 discloses a relay in which a printed circuit board is arranged parallel to the base, on the top of the magnet system. In this case, all the electrical connections between the printed circuit board and the base must be made via conductor parts which are in the form of bars and extend from the relay system at the side, at right angles to the base plane. If high load currents occur, such a structure could lead to heating problems, since the switching contacts on the top of the relay are also located in the region of the printed circuit board. The connecting elements are also in this case designed as round connectors which must be riveted into the base on their own.

German reference DE 38 34 413 A1 furthermore discloses the arrangement of a relay on a printed circuit board, load connecting elements being arranged in the form of flat connectors on the printed circuit board and at least some of them being connected via a stamped grid to the other components on the printed circuit board. This is actually not a plug-in module constructed on a base; instead of this, the relay is only seated in addition to other circuits on a relatively large printed circuit board, which has to have conventional printed circuit board connections, separately from the said load connectors.

Finally, U.S. Pat. No. 4,400,761 discloses a compact relay system, in the case of which a base which is provided with flat connectors is fitted with a printed circuit board standing upright. The relay is in this case not mounted on the base, but with all the connections on the printed circuit board, so that the load circuit must also be routed via the printed circuit board to the base connections. This not only results in heating problems but also requires additional electrical conductor elements and connecting points.

SUMMARY OF THE INVENTION

The aim of the present invention is to provide a plug-in modular relay of the type mentioned initially, which has a compact structure with as few parts as possible and also makes it possible to carry high load currents without any problems. The structure should furthermore be designed such that various applications can be coped with using a single basic structure so that relays having different modular circuits can be produced with a standard base structure.

This aim is achieved according to the invention in that all the electrical connections between the respective plug-in connecting elements and the printed circuit board are formed by conductor elements which are located alongside one another, are stamped integrally with their connecting elements, are arranged in an entirely or partially recessed manner in the top area of the base and are connected to the printed circuit board in a row, approximately at the same height, alongside one another in the vicinity of the lower edge of said printed circuit board and in that the lower end section of the printed circuit board rests on a side wall which runs at right angles to the base plane and in whose region the conductor elements in each case form solder connecting pins.

The modular relay according to the invention has a universal base design with a predetermined maximum number of conductor elements which can be arranged alongside one another on the top of the base or recessed in it, and all the connectors and connecting elements to the printed circuit board are available for different modular relays having different contact systems and different modular circuits. The individual conductor elements are stamped and preformed such that they in each case form flat connectors, which emerge integrally toward the bottom of the base in a desired connecting pattern, and, at their other end, form solder pins which emerge toward the printed circuit board side. If a modular relay together with its modular circuit requires less than the maximum number of connections provided, then those conductor elements which are not required can either not be connected or can be omitted during the production of the base, without the form or arrangement of the conductor elements which are used being changed.

As has already been explained initially, the relay magnet system is mounted on the base, and the contact elements are connected directly to the associated connecting elements. It is advantageous in this case for the stationary contact elements to be designed integrally with the associated conductor elements, which at the same time also form the plug-in connections and the solder connecting pins. The power supply for a contact spring which is connected to the armature is expediently implemented via a braid which is welded to the associated conductor element. The magnet system can be mounted on the base via the contact elements and, if necessary, via additional anchor points, which can be integrally formed either on the plastic coil former or on one of the metallic magnetic circuit parts, such as on the yoke.

In an expedient refinement, it can furthermore be provided for the coil connections to be connected directly to the printed circuit board. In an advantageous refinement, a flange of the coil former in this case forms column-like supports in the top region of the relay opposite the base, which supports rest on the printed circuit board and from which supports coil connecting pins emerge which are soldered into holes in the printed circuit board. As a result of such soldering of coil connecting pins on top of the relay, the overall structure of the base, printed circuit board and relay is given particularly good robustness and dimensional consistency.

The conductor elements which are arranged in or on the base can be mounted in slots on the base by plugging in. Where individual slots are unoccupied in the case of specific embodiments having less than the maximum number of conductor elements, these slots can be closed, at least toward the bottom of the base, by the plastic material of the base.

In another expedient refinement, it can be provided for at least some of the conductor elements to be embedded in the insulating material of the base. It is possible in this case as well, for one embodiment, for conductor elements which are not required not to be inserted into the mold during the forming of the base, for example in the case of plastic injection molding, as a result of which their space is filled with plastic. Mixed forms of embedding and plugging in are also possible. Thus, for example, it is provided in an expedient refinement for the conductor elements for the connections of the modular circuit to be embedded in the base, while the conductor elements for the load connections are fitted subsequently, by plugging in.

In order to couple the printed circuit board by its lower edge region to the solder connecting pins of the conductor elements it is, on the one hand, advantageous if the base forms a step in the corresponding region so that the printed circuit board rests against the vertical wall of this step; the solder connecting pins of the conductor elements in this case expediently emerge from the higher base section in the region of this vertical wall and are thus soldered to the printed circuit board directly in the region of the step. The step thus simplifies the mounting of the printed circuit board on the connecting pins and, in particular, firm seating of the connections is improved. That part of the base which is recessed downwards by the step also forms a bottom cover for the printed circuit board so that, as a result of the base edge being sealed with respect to a housing cap fitted on it, the relay including the printed circuit board is enclosed in a sealed manner.

On the other hand, the step makes the soldering process somewhat more difficult since it must be covered during wave-bath soldering. In order to avoid this problem during soldering, a development of the invention provides for the base to be designed in two parts, the stepped part not being connected to the actual base, for example by plugging in, until after the soldering of the printed circuit board.

This arrangement of the solder connecting pins in a row alongside one another can mean that all the solder connecting pins lie on a common plane. Alternatively, a mutual height offset between these solder connecting pins is also quite conceivable within the context of the invention, as long as they are arranged alongside one another.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
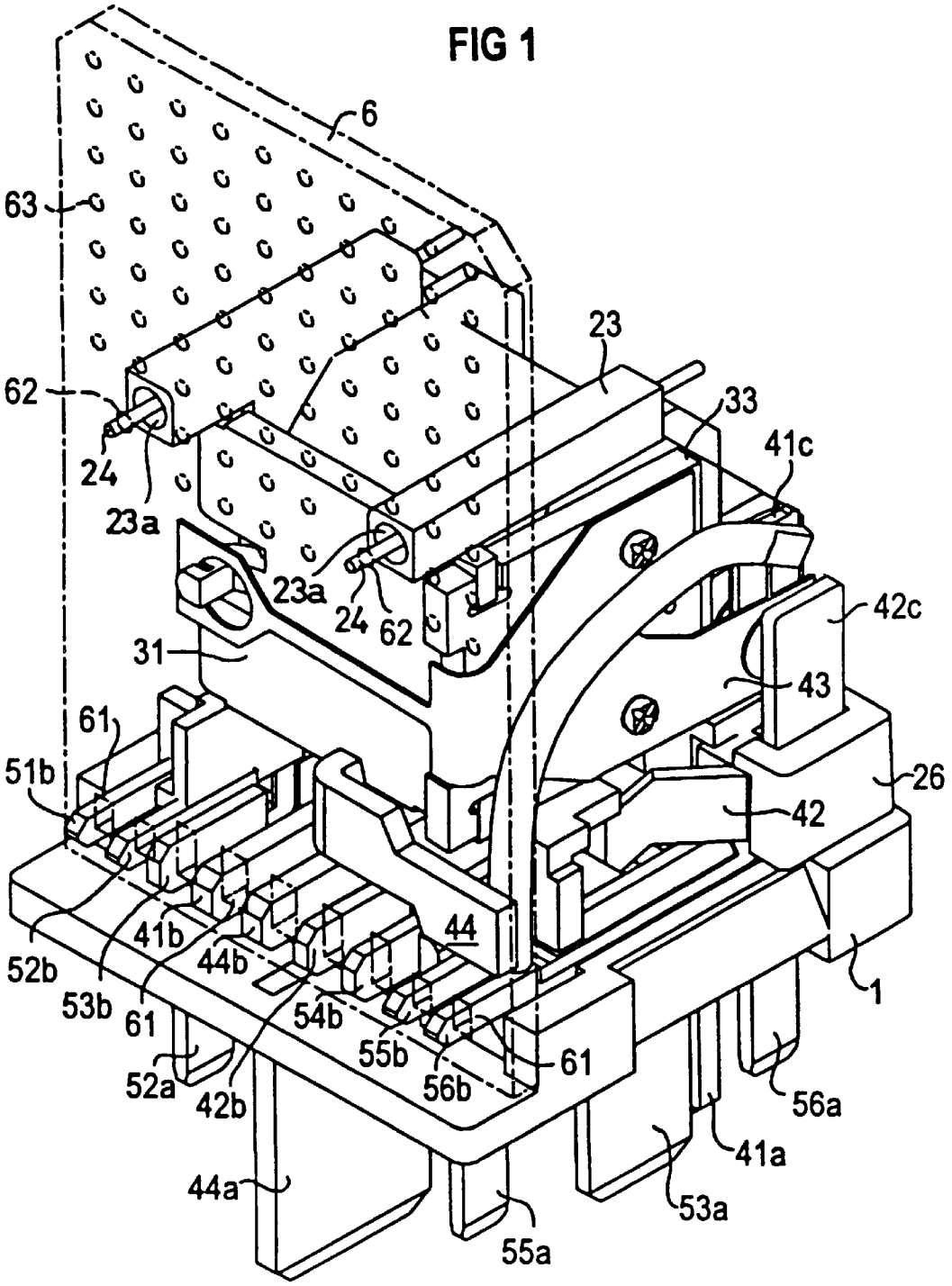
FIG. 1 shows a perspective illustration of a relay module with the relay system constructed on a base and with a printed circuit board which is indicated by dash-dotted lines.
Figure 2:
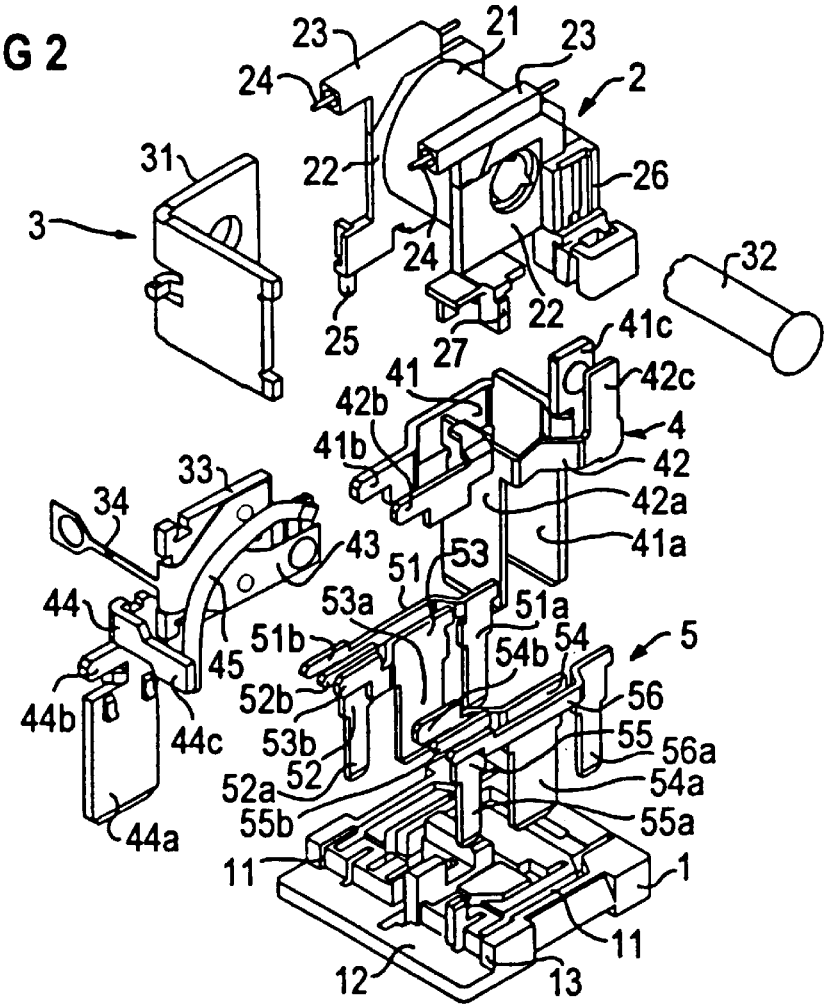
FIG. 2 shows an exploded illustration of the base and the individual parts of the relay from FIG. 1 (without the printed circuit board)
Figure 3:
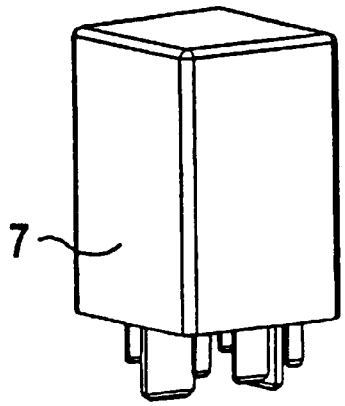
FIG. 3 shows an assembled relay module with a housing cap fitted on it.

The relay module which is illustrated in FIGS. 1 to 3 has a base 1 with plug-in slots 11 which are open toward the top and contain apertures, which cannot be seen, toward the bottom. An offset 12 in the form of a step is furthermore integrally formed on one side.

A relay system constructed in a conventional manner is seated on the base, with a coil former 2 as the mounting for a winding 21 and a magnet system 3. The latter essentially comprises an angular yoke 31, a core 32 arranged within the coil and an armature 33, which is in the form of a plate, is mounted on one yoke edge and is prestressed into a rest position via an armature restoring spring 34.

The coil former has two flanges 22 on both sides of the winding, which in each case form column-like supports 23 on the top opposite the base 1. Coil connecting pins 24 are in each case anchored in these supports 23, approximately parallel to the plane of the base 1. For support and mounting on the base 1, the coil former additionally has downward projecting pins 25 and supports 27 as well as an attachment 26, the latter at the same time being used for guidance and mounting of stationary contact elements 41*c* and 42*c*, which are still to be described later.

A contact arrangement for switching the relay circuit in the present example comprises a stationary make contact element 41*c* and a stationary break contact element 42*c* as well as a contact spring 43 which is designed as a continuation of the already mentioned armature restoring spring 34. The stationary contact elements 41*c* and 42*c* are designed integrally with in each case one conductor element 41 and 42, respectively, which are mounted in corresponding slots 11 in the base 1 by plugging in. The conductor element 41 additionally has a flat connector 41*a*, which emerges at the bottom through an opening in the base, and a solder connecting pin 41*b*, which emerges, parallel to the top of the base, on the step wall 13; in a corresponding manner, the conductor element 42 forms a flat connector 42*a*, which is integrally formed at the bottom, and a solder connecting pin 42*b*, which is integrally formed at the side. A conductor element 44 is used as the connecting element for the center contact spring 43 and forms a flat connector 44*a* to the bottom of the base and a solder connecting pin 44 toward the step side wall 13. A connecting web 44*c*, from which the load current is carried via a braid 45 to the contact spring 43, is additionally constructed on the conductor element 44. The contact arrangement 4 could, of course, be modified, for example, by providing only a break contact or a make contact; a bridge contact could also be implemented, and it would then be necessary for the two stationary contact elements 41*c* and 42*c* to lie on a plane and for the contact spring 43 to be designed as a link without its own connection.

A module connecting arrangement 5, comprising six conductor elements 51, 52, 53, 54, 55 and 56, is also provided in the base. All these conductor elements are mounted in slots 11 in the base by plugging in, to be precise in such a manner that they each form a flat connector 51*a*, 52*a*, 53*a*, 54*a*, 55*a* and 56*a*, respectively, to the bottom of the base, and a solder connecting pin 51*b*, 52*b*, 53*b*, 54*b*, 55*b* and 56*b*, respectively, toward the step wall 13. All the flat connectors on the bottom of the base are arranged according to a predetermined pattern, while all the solder connecting pins in the region of the step wall 13 lie alongside one another in a row. These solder connecting pins, which are stamped from the relevant conductor elements, may differ slightly in cross section, that is to say they have a larger cross section for the load circuit and (in contrast to the illustrated embodiment) may also under some circumstances vary in the height arrangement. Contact holes 61 in a printed circuit board 6 correspond to them, the lower edge of which printed circuit board which stands upright on the offset 12 of the base 1 and its lower edge region rests on the step side wall 13. In addition, in the region of the top of the relay, the printed circuit board 6 has two contact holes 62 for accommodating the coil connecting pins 24. Further contact holes 63 are advantageously used for accommodating and making contact with further components for a modular circuit, which contact holes 63 cannot be seen, in the same way as the conductor tracks.

During the assembly of the modular relay, the conductor elements 51 to 56 and the contact conductor elements 41, 42 and 44 are firstly plugged into the base 1 and, if appropriate, are fixed. After this, the coil former with the magnet system is fitted and mounted. Finally, the printed circuit board 6 is then plugged on and soldered, at the side, via the module solder connecting pins 51*b* to 56*b*, the contact solder connecting pins 41*b*, 42*b* and 44*b*, and via the coil connecting pins 62. In the region of their end resting on the printed circuit board, the supports 23 in each case have a conical recess 23*a* around the solder connecting pins 62, so that the solder cannot flow by capillary action to the relay side of the printed circuit board. Furthermore, the cutout is used for tolerance compensation and thus simplifies the assembly of the printed circuit board. Plugging a housing cap 7 onto the base 1 produces a closed housing, which can be sealed at the lower edge region. The lower edge of the printed circuit board 6 is also covered by the offset 12, which is in the form of a step.

In the case of the embodiment which has been described so far, all the conductor elements have been mounted in the base by plugging in. If it is intended to use less than the maximum shown number of nine conductor elements in an embodiment, the corresponding apertures for the flat connectors can be filled, or closed toward the underneath by a sprayed skin, even during the production of the base.

Figure 4:
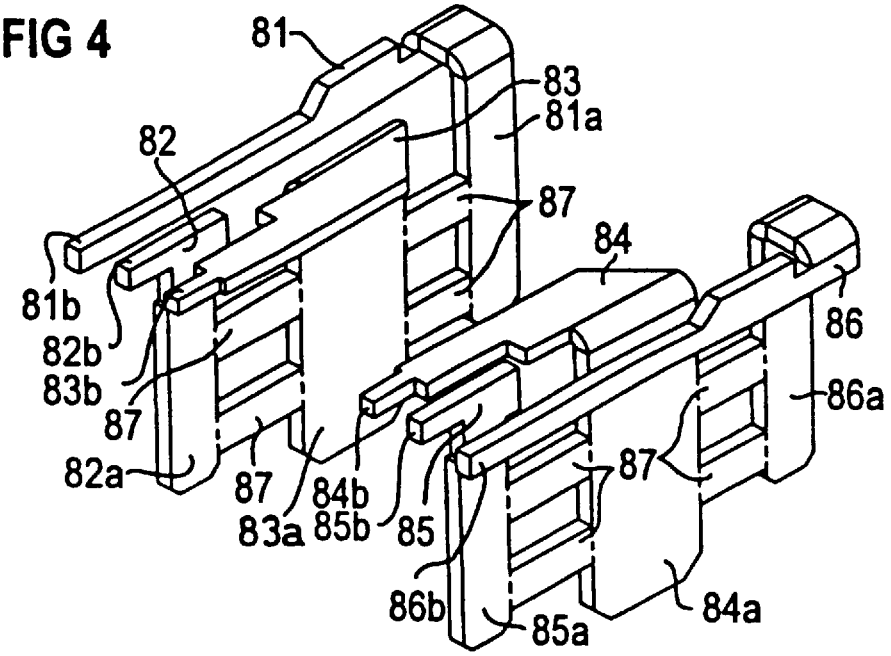
FIG. 4 shows two sheet-metal panels with conductor elements stamped out in groups, before being embedded in a base.
Figure 5:
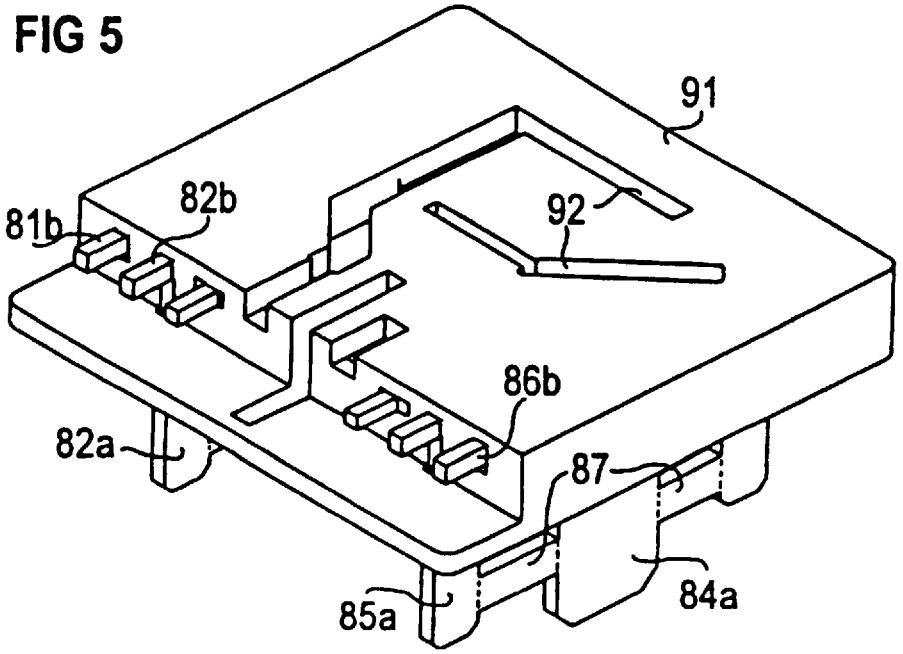
FIG. 5 shows a base after extrusion coating with embedded conductor elements according to FIG. 4.
Figure 6:
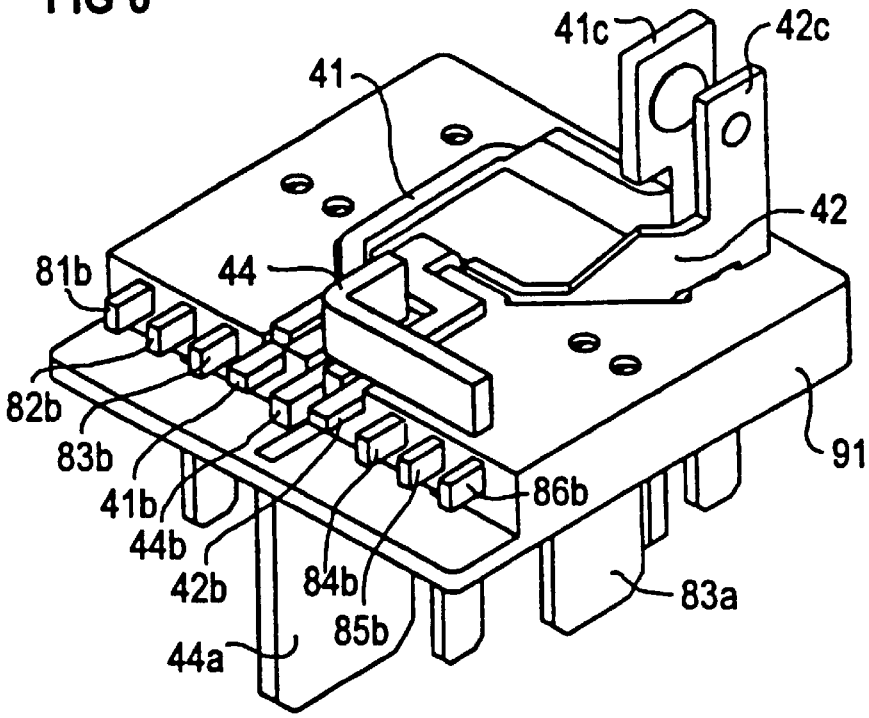
FIG. 6 shows a base according to FIG. 5 with additionally plugged-in conductor elements for the load connections of the relay.

A further embodiment of a base is shown in FIGS. 4 to 6 in various phases of production, some of the conductor elements being embedded in the plastic of the base. An embodiment is shown in which the conductor elements can be obtained by as few individual steps as possible. In this case, as is illustrated in FIG. 4, three conductor elements 81, 82, 83 or 84, 85 and 86, respectively, are each obtained from in each case one sheet-metal panel. The flat connectors 81*a*, 82*a* and 83*a* of one sheet-metal panel and 84*a*, 85*a* and 86*a* of the other sheet-metal panel in this case each lie on a plane, while the top sections of the conductor elements are in each case cut, angled and bent such that the solder connecting pins 81*b*, 82*b*, 83*b*, 84*b*, 85*b* and 86*b* which are formed at the ends all lie in a row.

The conductor elements on a panel are initially in each case connected to one another via webs 87 so that only two sheet-metal parts need be inserted into the injection mold. A base 91 according to FIG. 5 is now formed by extrusion coating the two panels, the dimensions of which base 91 correspond to those of the base 1 in FIGS. 1 and 2, only the module connecting elements already being embedded. The intermediate webs 87 are then cut through so that the individual conductor elements are electrically insulated from one another. Furthermore, the base 91 also has plug-in slots 92 for accommodating the conductor elements 41, 42 and 44 with the contact elements for the load circuit. These are designed as shown in the example in FIG. 2 and are plugged in in the same manner as there. A base shape according to FIG. 6 is thus obtained. The coil former 2, with the magnet system 3, and the printed circuit board 6 can then be mounted on this populated base as in the previous example.

Figure 7:
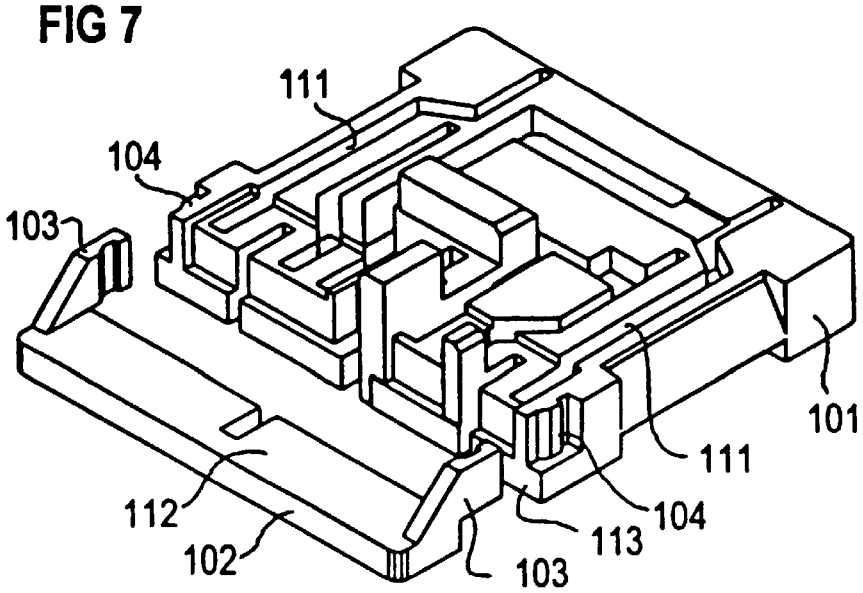
FIG. 7 shows a two-part base and FIG. 8 shows a perspective view of a somewhat modified embodiment of a relay module, in the state before final assembly, with premounted individual assemblies.

FIG. 7 describes a modification in the form of a two-part base. The base 101 which is illustrated there corresponds to the base 1 in FIGS. 1 and 2 with the exception that, instead of the step or the offset 12 there, this is formed by a separately manufactured second base part 102 which is in each case snapped by means of side arms 103 onto latching tabs 104 of the base 101 and can be mounted in this way. However, the base 101 is initially populated without the second base part 102 in that, as in FIG. 2, the conductor elements shown there are plugged into the slots 111. The printed circuit board 6 from FIG. 1 is then placed onto the side wall 113 and is plugged onto the solder connecting pins of the conductor elements. The printed circuit board can then be soldered easily, without any projecting base step. After this, the second base part 102 is plugged with the said side arms 103 onto the base 101. The base parts 101 and 102 now form a closed bottom part which, together with the cap 7, forms a closed housing. If necessary, the joint between the base parts 101 and 102 can also be additionally sealed, with the edge gap between the base and cap. This two-part construction of the base can, of course, also be used if the conductor elements are at least partially embedded, as is shown in FIGS. 4 to 6.

Figure 8:
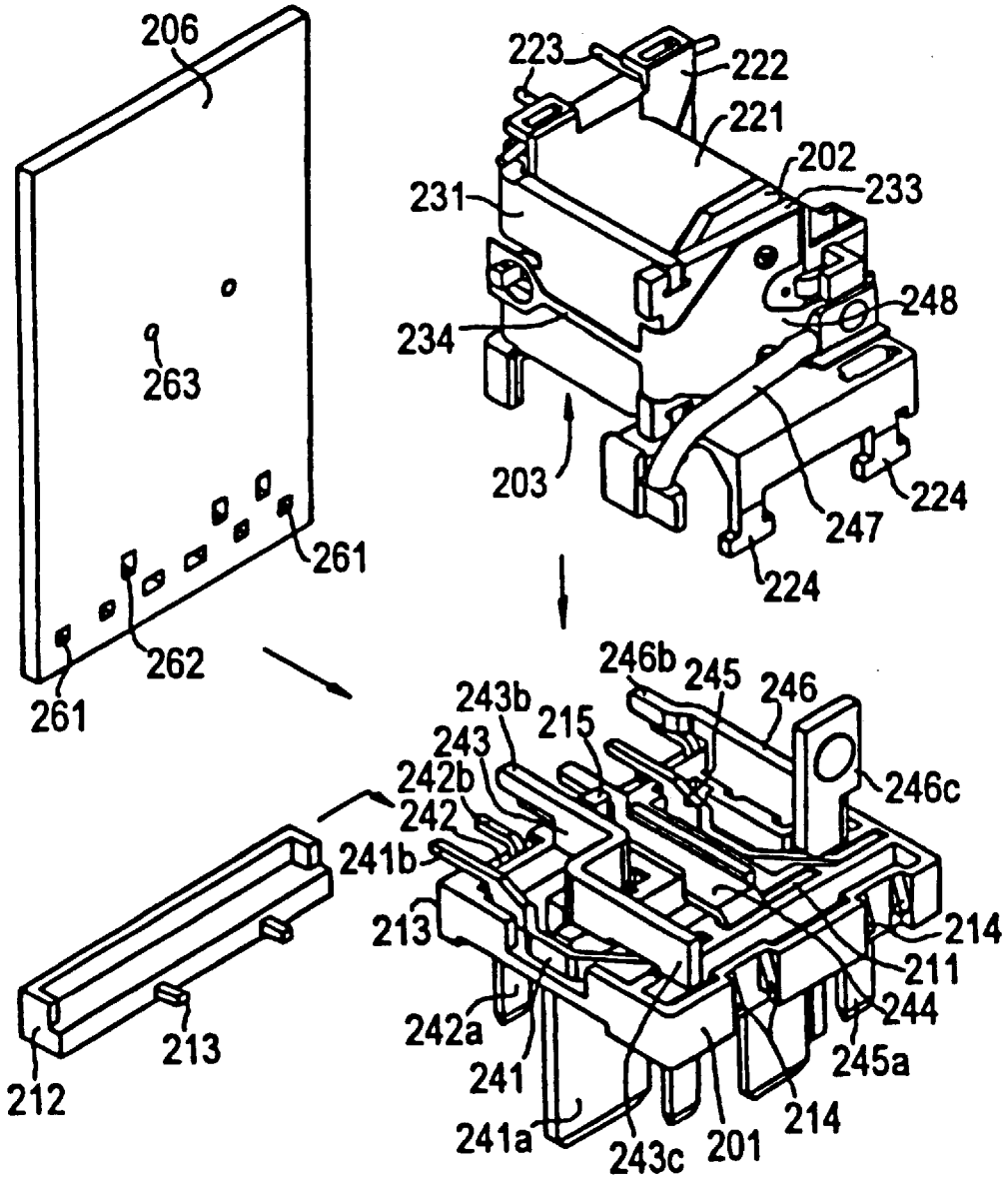

The relay module which is illustrated in FIG. 8 has a base 201 with plug-in slots 211 which are open at the top and contain apertures, which cannot be seen, at the bottom. Seated on the base is a relay system having a coil former 202 as a mounting for a winding 221 and a magnet system 203. The latter essentially comprises an angular yoke 231, a core which is arranged within the coil and an armature 233 which is in the form of a plate, is mounted on a yoke edge and is prestressed into a rest position via an armature restoring spring 234.

Conductor elements 241 to 246 are anchored in the base in the apertures 211 which are only partially visible; further lines are only partially visible. A flat connector 241*a*, 242*a* etc. which emerges at the bottom is integrally formed on each of the conductor elements. In addition, each conductor element has a solder connecting pin, for example 241*b*, 242*b* etc., which projects horizontally beyond the side wall 213. Most of these solder connecting pins are located alongside one another in a straight row; specific solder connecting pins, for example the solder connecting pin 243*b* or the solder connecting pin 246*b*, are admittedly located in the gap between two adjacent solder connecting pins, but are offset upward somewhat in height in order to obtain a greater insulating separation. A stationary make contact element 246*c* is integrally formed, standing upright, on the conductor element 246. In addition, the conductor element 243 has a connecting web 243*c* which extends transversely over the base surface and to which a braid 247 is welded, which carries the load current to a contact spring 248. This contact spring 248 is connected to the armature 233 and is integral with the restoring spring 234.

On the side facing away from the armature, the coil former 202 has a somewhat raised coil flange 222 in which coil connecting pins 223 are anchored. These coil connecting pins are angled such that they form solder connections parallel to the solder connecting pins 241*b* to 246*b*. In addition, T-shaped spring lugs 224 are integrally formed on the underneath of the coil former, opposite which spring lugs 224 there are corresponding latching wedges 214 on the base. A latching hook 215 is furthermore integrally formed on the base in the vicinity of the side wall 213, opposite which latching hook 215 there is a corresponding latching window, which cannot be seen, on the underneath of the coil flange 222. When the coil former is being mounted on the base, the latching lugs 224 slide with their side arms over the latching wedges 214 and latch in behind them at the end of the fitting movement. At the same time, the latching hook 215 latches in the said latching window in the coil former on the opposite side, so that the base and the coil former are attached to one another in a force-fitting and positively locking manner.

A printed circuit board 206 is fitted, standing upright with respect to the base plane, to the base 201 which is combined with the magnet system, to be precise to the side surface 213. Contact holes 261 and 262 are provided in the printed circuit board 206, in the vicinity of its lower edge, in a row corresponding to the solder connecting pins 241*b* to 246*b*. The contact holes 262 are in this case offset somewhat upward from the straight row of contact holes 261, in the same way as the somewhat raised connecting pins 243*b* and 246*b*, in order to ensure the already described, increased insulating separation. In addition, the printed circuit board 206 has two contact holes 263, which match the coil connecting pins 223, in the region of the top of the magnet system 203. After the printed circuit board 206 has been fitted, it is soldered to the solder connecting pins in the contact holes 261, 262 and 263, as a result of which the magnet system and the conductor elements which are anchored in the base are connected to a circuit, which cannot be seen, on the printed circuit board 206.

Finally, an additional base part is plugged onto the side surface 213 of the base 201 by means of attachment pins 213. The bottom of the printed circuit board 206, which was previously exposed for soldering, is covered in this way. It is thus possible to form a closed housing by plugging a housing cap, which is not illustrated, on the base 201 with the additional part 212, which closed housing can be sealed on the underneath by filling out capillary joints.

The maximum number of conductor elements are shown in each case in the examples described, six additional connections for the module thus being provided in each case in addition to three load connections. Depending on the application, these additional connections can be allocated to correspond to the modular circuit. If all the connections are not required, the corresponding conductor elements can also be omitted during production of the base, or it is possible to cut off connectors which are not required before or after mounting in the base.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A modular relay comprising:

a base, in which are anchored plug-in connecting elements for at least one load circuit, for one relay energizing circuit and for one modular circuit;

a coil former which is fitted with an electromagnet system having a coil, a core, a yoke and an armature and which is mounted upright on the base;

at least one stationary contact element and at least one moveable contact element, the contact elements being connected directly to associated plug-in connecting elements which are anchored in the base;

a printed circuit board which stands upright on the base, is fitted with the modular circuit and is electrically connected to at least some of the connecting elements of the base;

electrical connections between respective plug-in connecting elements of the plug-in connecting elements and the printed circuit board are formed by conductor elements which are located alongside one another, which are stamped integrally with their connecting elements, which are arranged in at least a partially recessed manner in a top area of the base and which are connected to the printed circuit board in a row, approximately at the same height, alongside one another in a lower end section of said printed circuit board;

the lower end section of the printed circuit board resting on a side wall which runs at right angles to a plane of the base and in whose region the conductor elements form solder connecting pins.

2. The modular relay as claimed in claim 1, wherein first solder connecting pins of the solder connecting pins are arranged in a straight row parallel to the base plane, and wherein second solder connecting pins are individually arranged between the first solder connecting pins with a slight upward offset.

3. The modular relay as claimed in claim 1, wherein coil connections of the relay are connected directly to the printed circuit board.

4. The modular relay as claimed in claim 1, wherein the coil former has a winding axis parallel to the plane of the base, and has at least one flange which rests on the printed circuit board, and wherein said at least one flange has coil connection pins in the top region of the relay, the coil connection pins being connected directly to the printed circuit board.

5. The modular relay as claimed in claim 1, wherein all the conductor elements are mounted in slots in the base, by plugging in.

6. The modular relay as claimed in claim 5, wherein unoccupied slots in the base are closed, at least toward a bottom of the base, by plastic material from which the base is formed.

7. The modular relay as claimed in claim 1, wherein the base is formed from an insulating material and wherein at least some of the conductor elements are embedded in the insulating material.

8. The modular relay as claimed in claim 7, wherein said at least some of the conductor elements lie in two common planes with flat connectors which stand upright, said at least some of the connector elements being angled and bent in an embedding region such that said conductor elements and said flat connectors lie alongside one another in a common row, integrally with the solder connecting pins which are cohesive therewith.

9. The modular relay as claimed in claim 7, wherein the base forms a step in a region of the printed circuit board, and wherein the solder connecting pins emerge from a wall of the step.

10. The modular relay as claimed in claim 1, wherein the base has first and second base parts, wherein the printed circuit board is mounted resting on a side closure wall of the first base part, and with the second base part is connected to the first base part underneath the printed circuit board, adjacent to the closure wall.

11. The modular relay as claimed in claim 10, wherein the second base part is connected to the first base part by at least one of plug elements and latching elements.

12. The modular relay as claimed in claim 1, wherein the coil former and the base are connected to one another by interlocking latching elements.

13. The modular relay as claimed in claim 12, wherein at least one T-shaped latching lug is integrally formed on one of the coil former and the base and latches in behind inclined ramps on one of the base and the coil former, respectively.

14. The modular relay as claimed in claim 12, wherein at least one latching hook is integrally formed on one of the base and the coil former and latches in a window in one of the coil former and the base, respectively.

* * * * *